US010689594B2

(12) United States Patent
Ho

(10) Patent No.: US 10,689,594 B2
(45) **Date of Patent: *Jun. 23, 2020**

(54) RECOVERY OF TOCOPHEROLS/TOCOTRIENOLS, CAROTENOIDS, GLYCEROLS, STEROLS AND FATTY ACID ESTERS FROM CRUDE VEGETABLE OIL AND THE PROCESS THEREOF

(71) Applicant: David Sue San Ho, Ipoh (MY)

(72) Inventor: David Sue San Ho, Ipoh (MY)

( * ) Notice: Subject to any disclaimer, the term of this patent is extended or adjusted under 35 U.S.C. 154(b) by 0 days.

This patent is subject to a terminal disclaimer.

(21) Appl. No.: 15/543,125

(22) PCT Filed: May 7, 2015

(86) PCT No.: PCT/MY2015/050030

§ 371 (c)(1),
(2) Date: Jul. 12, 2017

(87) PCT Pub. No.: WO2016/114646

PCT Pub. Date: Jul. 21, 2016

(65) Prior Publication Data

US 2018/0023031 A1 Jan. 25, 2018

(30) Foreign Application Priority Data

Jan. 12, 2015 (MY) ..... PI2015700094

(51) Int. Cl.

| | |
|---|---|
| ***C11B 3/12*** | (2006.01) |
| ***C11B 3/02*** | (2006.01) |
| ***C11C 3/00*** | (2006.01) |
| ***C11B 7/00*** | (2006.01) |

(52) U.S. Cl.
CPC ..... *C11B 3/12* (2013.01); *C11B 3/02* (2013.01); *C11B 7/0008* (2013.01); *C11C 3/003* (2013.01)

(58) Field of Classification Search
CPC ..... C11B 3/12
USPC ..... 549/413
See application file for complete search history.

(56) References Cited

U.S. PATENT DOCUMENTS

| | | | |
|---|---|---|---|
| 5,190,618 | A | 3/1993 | Top et al. |
| 5,627,289 | A | 5/1997 | Jeromin et al. |
| 6,407,306 | B1 | 6/2002 | Peter et al. |
| 6,586,201 | B1 | 7/2003 | May et al. |
| 7,544,822 | B2 | 6/2009 | Ho |
| 2007/0238886 | A1 | 10/2007 | Ho |
| 2008/0015367 | A1 | 1/2008 | Dobbins et al. |
| 2011/0220483 | A1 | 9/2011 | Margnat et al. |

FOREIGN PATENT DOCUMENTS

| | | |
|---|---|---|
| EP | 1426368 | 6/2004 |
| EP | 1894913 | 3/2008 |
| WO | 2000049116 | 8/2000 |

OTHER PUBLICATIONS

International Search Report for PCT/MY2015/050125 dated Aug. 10, 2015.
Written Opinion of the International Searching Authority for PCT/MY2015/050125 dated Aug. 10, 2015.
International Preliminary Report on Patentability for PCT/MY2015/050125 dated May 3, 2017.
International Search Report for PCT/MY2016/050007 dated Jun. 14, 2016.
Written Opinion of the International Searching Authority for PCT/MY2016/050007 dated Jun. 14, 2016.
International Preliminary Report on Patentability for PCT/MY2016/050007 dated Apr. 19, 2017.
Written Opinion of the International Preliminary Examining Authority for PCT/MY2016/050007 dated Jan. 20, 2017.
Aranda, D. A. G. et al., "Acid-Catalyzed Homogeneous Esterification Reaction for Biodiesel Production From Palm Fatty Acids," Catalysis Letters, 2008, vol. 122, pp. 20-25.

*Primary Examiner* — Taofiq A Solola
(74) *Attorney, Agent, or Firm* — Preston Smirman; Smirman IP Law, PLLC

(57) ABSTRACT

A process for recovering tocotrienols/tocopherols, carotenoids and sterols from crude vegetable oil, characterised in that prior to the recovery steps, the amount of the free fatty acids in the oil is reduced to 3.50% by weight by distillation or neutralization.

34 Claims, No Drawings

RECOVERY OF TOCOPHEROLS/TOCOTRIENOLS, CAROTENOIDS, GLYCEROLS, STEROLS AND FATTY ACID ESTERS FROM CRUDE VEGETABLE OIL AND THE PROCESS THEREOF

CROSS-REFERENCE TO RELATED APPLICATION

The instant application is a national phase of PCT International Patent Application Serial No. PCT/MY2015/050030 filed May 7, 2015, and claims priority to Malaysia Patent Application Serial No. PI2015700094, filed Jan. 12, 2015, the entire specifications of both of which are expressly incorporated herein by reference.

FIELD OF INVENTION

The present invention relates to recovery of valuable constituents from oils. More particularly, the invention pertains to a process involving a pre-treatment step, such as molecular distillation or neutralization, to reduce free fatty acid content in crude palm oil or other vegetable oil, in which the pre-treated oils are further processed to recover high quality tocotrienols/tocopherols, carotenoids, sterols and optionally glycerols as well as free fatty acids in form of ester.

BACKGROUND OF THE INVENTION

Over the years, crude vegetable oils such as palm, palm kernel, rice bran, soy bean, sunflower, canola, rapeseed, cottonseed, safflower and corn oil have been identified as containing high levels of phytonutrients or constituents beneficial to human health. These beneficial constituents may include but not limited to tocopherols, tocotrienols, carotenoids and steroids.

Tocopherols and tocotrienols are valuable constituents of vegetable oils because of their abilities to act as antioxidants and to provide protection against cell damage in the brain, tumors and various types of cancers, as well as to assist in the rehabilitation of damaged cells. Unique molecular structure of the tocotrienols further imparts hypocholesterolemic characteristics, thereby helping to maintain a healthy cardiovascular system. Specifically, tocotrienols can help lower blood cholesterol level through cleansing of the arteries of accumulated cholesterol.

Carotenoids are natural pigments synthesized by plants imparting yellow, orange or red colour. Of all the carotenoids, alpha-carotene, beta-carotene and beta-cryptoxanthin are precursors to vitamin A (or retinol), or interchangeably known as provitamin A, serving as a source of vitamin A. Other carotenoids such as lutein, lycopene and zeaxanthin cannot be converted to vitamin A but they are still of special interest because they are good antioxidants.

Plant based sterols, on the other hand, are recognized for their abilities to block absorption of cholesterols and reduce blood cholesterol level. Because the plant sterols are nearly identical to the cholesterols, they compete with each other for absorption in the small intestines. However, plant sterols are poorly absorbed by humans and they appear to block the absorption of the dietary cholesterols, thereby reducing the blood cholesterol level, as well as the risk of coronary heart disease. Some research studies have also demonstrated that the plant sterols possess anti-cancer, anti-inflammatory, anti-atherogenic and antioxidant characteristics.

In view of the foregoing, it is desired to extract or recover these beneficial constituents from the crude vegetable oils. Numerous recovery techniques have been presented in the past, such as solvent extraction, solvent fractionation, ion exchange resin treatment and chromatography method. However, these techniques have several drawbacks, including low yield, substantial degradation of constituents throughout the process, use of carcinogenic organic solvent, etc. Accordingly, there exists a need for an improved method for recovery of tocotrienols/tocopherols, carotenoids and sterols from oils.

The present invention provides a process for isolating tocotrienols/tocopherols, carotenoids and sterols from crude oils, particularly palm oils and refined palm oil distillates, and simultaneously recovering glycerols and free fatty acids in form of esters. In order to further improve quality of the recovered/isolated components, either molecular distillation or neutralization is utilized to the present invention as a pre-treatment step so as to reduce fatty acid content in the crude oils prior to recovery of components. Consequently, it facilitates to produce higher yield of phytonutrient (based on purity and mass yield) and a cleaner starting material for downstream processes. More importantly, various oil compositions with high free fatty acid could be used in the present invention for recovery of phytonutrients, which imparts versatility to it as well as the type of oil used.

SUMMARY OF INVENTION

One of the objects of the invention is to provide a process for isolating tocotrienols, tocopherols, carotenoids and sterols from crude oils, particularly palm oils and refined palm oil distillates, and simultaneously recovering glycerols and free fatty acids in form of esters.

Another object of the invention is to provide a process utilizing molecular distillation or neutralization as a pre-treatment step for reducing free fatty acid content in the crude oils before being processed further, thereby improving quality of the components recovered or isolated from the oils.

Still another object of the invention is to provide a process for isolation and recovery of tocotrienols, tocopherols, carotenoids and sterols without being degraded or modified throughout the process.

Yet another object of the invention is to utilize transesterification as a post-processing step so as to further increase the carotenoid content therein to more than 20 wt %.

At least one of the preceding objects is met, in whole or in part, by the invention, in which one of the embodiments of the invention describes a process for recovering tocotrienols/tocopherols, carotenoids and sterols from crude vegetable oil, characterised in that prior to the recovery steps, the amount of the free fatty acids in the oil is reduced to less than 3.50% by weight.

Preferably, the amount of the free fatty acids in the oil is reduced by distillation or neutralization.

One of the preferred embodiments of the invention describes a process for recovering tocotrienols/tocopherols, carotenoids and sterols from crude vegetable oil, characterised in that prior to the recovery steps, the amount of the free fatty acids in the oil is reduced to less than 3.50% by weight by distillation. Preferably, the distillation is performed to produce a first fraction enriched with carotenoids and a second fraction enriched with tocotrienols/tocopherols. The recovery process comprises the steps of transesterifying the first fraction in the presence of an alcohol and a basic catalyst to convert the glycerides therein to fatty acid esters and glycerine, 3.50 forming a transesterified mixture comprising glycerine, fatty acid esters and carotenoids, followed by distilling the transesterified mixture to separate carotenoids; and esterifying the second fraction in the presence of an alcohol and an acid catalyst to convert fatty acids therein to fatty acid esters, forming an esterified mixture comprising fatty acid esters and tocotrienols/tocopherols, followed by distilling the esterified mixture to separate tocotrienols/tocopherols.

A further embodiment of the invention describes a process for recovering tocotrienols/tocopherols, carotenoids and sterols from crude vegetable oil, characterised in that prior to the recovery steps, the amount of the free fatty acids in the oil is reduced to less than 3.50% by weight by neutralization. Preferably, the neutralization is performed such that a basic solution is added to the crude oil to convert the fatty acids to salts which are to be separated by using one or more filters, centrifuge or separators.

The recovery process according to the further embodiment of the invention comprises the steps of, after neutralizing the crude oil to reduce its free fatty acid content, transesterifying the neutralized oil in the presence of an alcohol and a basic catalyst to convert the glycerides therein to fatty acid esters and glycerine, forming an ester-rich fraction and a glycerol-rich fraction; separating the ester-rich fraction from the glycerol-rich fraction; distilling the ester-rich fraction to produce a concentrated stream comprising tocotrienols/tocopherols, carotenoids and sterols; further transesterifying the concentrated stream in the presence of an alcohol and a basic catalyst to form an ester-enriched fraction and a glycerol-rich fraction; and repeating the transesterification, separation and distillation sequentially and repeatedly to obtain a composition with predetermined concentration of tocotrienols/tocopherols, carotenoids and sterols.

One skilled in the art will readily appreciate that the invention is well adapted to carry out the aspects and obtain the ends and advantages mentioned, as well as those inherent therein. The embodiments described herein are not intended as limitations on the scope of the invention.

DETAILED DESCRIPTION OF THE INVENTION

Hereinafter, the invention shall be described according to the preferred embodiments of the present invention and by referring to the accompanying description and drawings. However, it is to be understood that limiting the description to the preferred embodiments of the invention and to the drawings is merely to facilitate discussion of the present invention and it is envisioned that those skilled in the art may devise various modifications without departing from the scope of the appended claim.

The present invention relates to a process involving a pre-treatment step, such as molecular distillation and neutralization, to reduce free fatty acid content in crude vegetable oil, whereby the pre-treated oils with low fatty acid content are subjected to further processing for recovery of constituents including tocotrienols, tocopherols, carotenoids, sterols and optionally, glycerols as well as free fatty acids, in form of ester.

The crude vegetable oil referred herein preferably has a composition comprising tocotrienols/tocopherols, carotenoids, sterols, fatty acids and glycerides including monoglycerides, diglycerides and triglycerides, wherein the free fatty acids are present in an amount of more than 3.50% by weight of total composition. Other types of crude oil as crude palm oil, red palm oil, red palm olein, red palm fiber oil and palm oil distillate can also be processed by the process depicted herein throughout the description.

It should be appreciated that the term "tocotrienol/tocopherol" or "tocopherol/tocotrienol" used herein throughout the description shall refer to any one or a combination of tocotrienol and tocopherol.

The present invention provides a process for recovering tocotrienols/tocopherols, carotenoids and sterols from crude vegetable oil, characterised in that prior to the recovery steps, the amount of the free fatty acids in the oil is reduced to less than 3.50% by weight. Preferably, the amount of the free fatty acids in the crude oil is reduced by subjecting the crude oil to distillation or neutralization.

One of the preferred embodiments of the invention discloses a process for recovering tocotrienols/tocopherols, carotenoids and sterols from crude vegetable oil, characterised in that prior to the recovery steps, the amount of the free fatty acids in the oil is reduced to less than 3.50% by weight by distillation. The distillation depicted in this step is preferably vacuum distillation, and may involve one or more distillation columns to produce a first fraction enriched with carotenoids and a second fraction enriched with tocotrienols/tocopherols.

In one preferable embodiment, the distillation is performed in two distillation columns arranged in series, the first column operating at a temperature of 90 to 200° C. and a pressure ranging from 10 to 100 kPa and the second column at 120 to 250° C. and 0.10 to 10 kPa. Substantial proportion of tocotrienols/tocopherols, sterols and fatty acids is separated from the crude oil as distillate from the first distillation column, thereby reducing the amount of the free fatty acids in the oil. The remaining oil components leave the first distillation column as a residue stream for feeding into the second column for further separation of tocotrienols/tocopherols, sterols and fatty acids. In the second distillation column, tocotrienols/tocopherols, sterols and fatty acids are substantially separated to produce a bottom stream rich of carotenoids, referred to as the first fraction mentioned in the preceding description. Correspondingly, the tocotrienols/tocopherols, sterols and fatty acids recovered from the second distillation column as a distillate stream, as well as the distillate stream from the first distillation column, makes up the second fraction which is enriched with tocotrienols/tocopherols.

In a more preferable embodiment, prior to the distillation, the crude oil is heated, or subjected to a nozzle spray vacuum dryer or a column dryer to reduce the moisture content to below 0.30% by weight. Preferably, the drying process is performed at a temperature of 40 to 80° C. under vacuum or a pressure of 100 kPa (equivalent to 76 cm Hg) for 0.5 to 24 hours.

It should be appreciated that the term "distillation" used herein throughout the description shall not be limited to only molecular distillation, but also refer to other types of distillation, depending on the properties of the component(s) to be recovered.

The process according to the preferred embodiment of the invention comprises the recovery steps of transesterifying the first fraction in the presence of an alcohol and a basic catalyst to convert the glycerides therein to fatty acid esters and glycerine, forming a transesterified mixture comprising glycerine, fatty acid esters and carotenoids, followed by distilling the transesterified mixture to separate carotenoids; and esterifying the second fraction in the presence of an alcohol and an acid catalyst to convert fatty acids therein to fatty acid esters, forming an esterified mixture comprising fatty acid esters and tocotrienols/tocopherols, followed by distilling the esterified mixture to separate tocotrienols/tocopherols.

Prior to transesterifying the first fraction, it is desirable to remove moisture contained therein by heating such that the moisture is evaporated, thereby reducing the moisture content of the first fraction to a level of less than 0.30% by weight.

Subsequently, the first fraction with reduced moisture content is transesterified in the presence of an alcohol and a basic catalyst to convert the glycerides in the oil to fatty acid esters and glycerine, thus forming a transesterified mixture comprising glycerine, fatty acid esters, carotenoids and other impurities, such as sterols and glycerides. The alcohol used in transesterification of the first fraction is preferably a lower alkyl alcohol such as methanol, ethanol, iso-propanol and butanol, whilst the basic catalyst is sodium methoxide, sodium hydroxide in methanol, potassium methoxide or potassium hydroxide in methanol. Also referring to the preferred embodiment of the invention, the transesterification is conducted at a temperature of 35 to 80° C. for 0.5 to 12 hours under atmospheric pressure, with or without agitation, but preferably with continuous agitation at 30 to 80 rpm. The ratio of the carotenoid-rich first fraction to the transesterification solution (i.e. the mixture of basic catalyst and alcohol) may range from 0.5-10:1.

In accordance with the preferred embodiment of the invention, it is desirable to separate the glycerine from the transesterified mixture. It can be achieved by subjecting to centrifugation or gravitational settling to produce an ester-rich portion and a glycerine-rich portion comprising 20 to 40% by weight of glycerine.

The glycerine-rich portion is neutralized using an acid such as hydrochloric acid, acetic acid or sulphuric acid, at a temperature of 35 to 90° C., to convert the excessive basic catalyst present therein to salt which can be easily separated from the glycerine, thereby producing 75 to 90% by weight of glycerine. Preferably, the neutralization is performed for a period of 0.5 to 24 hours, so as to ensure complete conversion. Subsequently, the resultant mixture is subjected to a settling step for a period of 0.5 to 12 hours, for separating other possible residual oil matters from glycerine. Upon removal of these residual oil matters, the remaining product mixture is heated, while being agitated continuously, to a temperature of 70 to 100° C. under vacuum (or a pressure equivalent to 100 kPa or 76 cm Hg), in order to remove the moisture or solution present therein by evaporation.

The ester-rich portion obtained from centrifugation or gravitational settling of the first mixture is subjected to either direct-current or counter-current water washing, so as to substantially remove the excessive catalyst and possibly, unreacted alcohol and other impurities such as soaps which may be formed during the process and aqueous soluble unwanted compounds. Hot or cold water can be used in this step but preferably, water heated to a temperature ranging from 40 to 80° C. is used. As preferred by the present invention, the washing step is performed repeatedly until the pH of the ester-rich portion falls to a range of 6 to 8.

After washing, the moisture content in the ester-rich portion may be increased to approximately 2% by weight or lower. Therefore, it is of particular interest to reduce the moisture content therein to less than 0.30% by weight prior to subjecting to further processing. It can be achieved by heating or vacuum drying the washed ester-rich portion to a temperature of 35 to 80° C. for 0.5 to 12 hours, under vacuum or a pressure of 100 kPa (equivalent to 76 cm Hg) substantially removing the moisture present therein.

After reducing the moisture content of the ester-rich portion to less than 0.30%, the resulting ester-rich portion is distilled for recovery of carotenoids from the ester-rich fraction. It should be appreciably noted that the distillation in this step is similar to that for reducing the fatty acid content, as depicted in the foregoing. Specifically, the distillation is vacuum distillation conducted in two distillation columns arranged in series, the first column operating at a temperature of 120 to 180° C. and at a pressure of 10 to 100 kPa, and the other column (positioned after the first column) operating at 120 to 180° C. and 0.1 to 10 kPa. Those of ordinary skill in the art should appreciate the fact that the first distillation column has an operating temperature lower than the subsequent column.

From the first column, fatty acid esters and tocotrienols/tocopherols are primarily recovered as distillate, whilst all other components remained unrecovered are discharged as a residue stream which is to be fed into the next column for separation of carotenoids. Substantial portion of fatty acid esters and tocotrienols/tocopherols is, again, removed from the next column as distillate, with tocotrienols/tocopherols present in an amount of 3 to 8 wt %. At the same time, a residue stream concentrated in carotenoids is produced, in which the carotenoids are present in an amount of 8 to 20% by weight.

In a more preferable embodiment, prior to distillation, the ester-rich portion is heated, or subjected to a column dryer or by vacuum distillation, to reduce the moisture content to below 0.01% by weight.

In another preferable embodiment, the distillate streams obtained in this distillation step, comprising fatty acid esters and tocotrienols/tocopherols, can be subjected to further processing to produce streams with higher concentration of tocotrienols/tocopherols or sold to the global market as that obtained.

The residue stream concentrated in carotenoids, or referred interchangeably to as "distilled transesterified mixture", is subjected to further processing. Preferably, the distilled transesterified mixture is treated with an organic solvent such as hexane, heptane or pentane. The resulting mixture is continuously agitated and chilled, forming crystallised carotenoids. Subsequently, the mixture is centrifuged, producing a liquid top layer and a semi-solid bottom layer, in which the bottom layer comprises crystallised carotenoids in an amount of 28 to 45% by weight.

Preferably, the bottom layer is subjected to evaporation using a conventional evaporator to remove the solvent content therein for recovery of carotenoids. Upon heating to a temperature of 45 to 80° C. under vacuum condition of 70 to 75 cm Hg, the solvent is substantially evaporated, thereby reducing the solvent content to a level of 1% or lower. In one preferred embodiment, the evaporation is conducted for duration of 0.5 to 96 hours, where upon removal of solvent, it produces a sludge-like compound, which is thick and viscous in terms of texture and physical appearance.

The top layer may optionally be transesterified in the presence of an alcohol and a basic catalyst. It should be appreciated that this additional transesterification step aids to increase the carotenoid content in the top layer to a level of more than 20% by weight. The alcohol used in this step is preferably a lower alkyl alcohol, more preferably methanol, whilst either sodium methoxide or potassium methoxide is used as basic catalyst. Still referring to the preferred embodiment, transesterification of the top layer is conducted at a temperature of 40 to 60° C. at atmospheric pressure, with or without agitation, but preferably with agitation. It is also preferred that the ratio of the top layer to the transesterification solution (i.e. the mixture of methoxide salt and methanol) is 4:5.

After transesterifying the top layer, the transesterified product mixture formed thereof is washed by contacting it with a methanolic acidic solution, preferably containing 1 to 2% by weight of hydrochloric acid, to remove undesirable impurities present therein. One should appreciate the fact that such washing step is performed at a slightly heated condition, particularly at a temperature of 28 to 50° C. under atmospheric pressure, and that the ratio of methanolic acidic solution to the transesterified product mixture is in a range of 4-7:1. Subsequently, the washed product mixture is dried, forming a product comprising carotenoids in an amount of 20 to 30% by weight.

In accordance with the preceding description, the second fraction enriched with tocotrienols/tocopherols is esterified in the presence of an alcohol and an acid catalyst to convert the fatty acids present in the oil to fatty acid esters, thus forming an esterified mixture comprising essentially glycerides, fatty acid esters, sterols and tocopherols/tocotrienols. Preferably, the alcohol used in this esterification step is a lower alkyl alcohol such as methanol, ethanol, isopropanol and butanol, whilst hydrochloric acid, phosphoric acid, citric acid or other suitable acid can be used as the acid catalyst. As preferred by the present invention, the acidic esterification is conducted at a temperature of 5 to 90° C. for 0.5 to 6 hours, with or without agitation, but preferably with agitation. The ratio of the acid catalyst to the lower alkyl alcohol in the esterification solution may range from 0.005-5:1.

Subsequently, the esterified mixture is subjected to direct-current or counter-current water washing so as to substantially remove the excessive catalyst, unreacted alcohol and other potential impurities. More preferably, the esterified mixture is repeatedly washed until the pH of the mixture achieves a range of 6 to 8. Hot or cold water can be used in this step but preferably, water heated to a temperature ranging from 35 to 90° C. is used.

The washed esterified mixture is then heated so as to evaporate and substantially remove the moisture contained therein. The heating step is preferably performed at a temperature of 35 to 80° C. for 0.5 to 10 hours under atmospheric condition. Consequently, the moisture content is reduced to an amount of less than 0.30% by weight.

In accordance with the preferred embodiment, the esterified mixture is, upon drying, distilled for recovery of tocopherols/tocotrienols. Like the distillation steps depicted in the foregoing, the distillation mentioned in this step is also vacuum distillation. Preferably, this distillation step is conducted in two distillation columns arranged sequentially, one column operating at 120 to 180° C. and 0.01 to 10 kPa, and the next column operating at 120 to 180° C. and 0.01 to 3 kPa. Those of ordinary skill in the art should appreciate the fact that the first distillation column has an operating temperature lower than the subsequent column.

From the column operating at 0.01 to 10 kPa, fatty acid esters are primarily recovered as distillate. The rest of the components leaving the column as a residue stream are fed into the other column, which operates at 0.01 to 3 kPa, for separation of tocopherols/tocotrienols. Similarly, fatty acid esters are substantially removed from the column as distillate, whereas a residue stream comprising tocotrienols/tocopherols, sterols and glycerides is recovered, whereby the tocotrienols/tocopherols are present in an amount ranging from 1 to 5 wt %. More preferably, prior to distillation, the second fraction is further heated, or subjected to a column dryer or by vacuum distillation, to further reduce the moisture content to below 0.01% by weight.

The residue stream from the distillation, or referred interchangeably to as "distilled esterified mixture", is subjected to another transesterification process in the presence of an alcohol and a basic catalyst to convert the glycerides contained therein to fatty acid esters and glycerine, thus forming a product mixture comprising glycerine, fatty acid esters, sterols, tocopherols and tocotrienols. Preferably, the alcohol used in the transesterification step is a lower alkyl alcohol such as methanol, ethanol, iso-propanol and butanol, whilst the basic catalyst can be either sodium methoxide or potassium methoxide. It is preferred that the transesterification is conducted at a temperature of 5 to 90° C. for 0.5 to 6 hours, with or without agitation, but preferably with agitation. It is also preferable that the ratio of the product mixture to the esterification solution (i.e. the mixture of basic catalyst and alcohol) may range from 0.5-10:1.

Still referring to the preferred embodiment of the invention, the product mixture obtained from transesterification of the distilled esterified mixture is subjected to another multi-stage distillation for further recovery of tocopherols/tocotrienols.

More preferably, prior to distillation, the product mixture is subjected to direct-current or counter-current water washing so as to remove the excessive catalyst, unreacted alcohol and other potential impurities such as sterols. It is also desired to wash the product mixture repeatedly until the pH of the ester-rich portion achieves a range of 6 to 8. In this washing step, hot or cold water can be used but preferably, water heated to a temperature ranging from 40 to 80° C. is used.

Subsequently, the washed product mixture is heated to reduce the moisture content to an amount of less than 0.30% by weight. It should be appreciated that the heating condition in this step is identical to that mentioned in the foregoing, in which the washed product mixture is heated to 35 to 80° C. under atmospheric pressure for 0.5 to 10 hours.

Upon removal of moisture from the product mixture, the dried product mixture is distilled for further recovery of tocopherols/tocotrienols. The distillation is preferred to be conducted as that depicted for the distillation in the previous steps. The columns are arranged sequentially, one column operating at a temperature of 120 to 180° C. and a pressure of 0.01 to 1 kPa and the subsequent column operating at 120 to 180° C. and 0.01 to 3 kPa. Those of ordinary skill in the art should, again, appreciate the fact that the first distillation column has an operating temperature lower than the subsequent column. Like the distillation operations in the preceding description, fatty acid esters are primarily recovered as distillate from the column operating at the pressure of 0.01 to 1 kPa. The remaining components are removed as a residue stream which is to be fed into the subsequent column to recover tocopherols/tocotrienols. From the subsequent distillation column, fatty acid esters are substantially removed as distillate, whereas the residue stream is a composition having pre-determined concentration of tocotrienols/tocopherols, sterols and other potential impurities. In the present invention, the composition preferably comprises tocotrienols/tocopherols in an amount ranging from 5 to 35% by weight.

In a more preferable embodiment, prior to distillation, the product mixture is heated, or subjected to a column dryer, to reduce the moisture content to below 0.01% by weight.

Since there is presence of sterols in the desired composition, it is, therefore, preferred to subject the desired composition to crystallisation in the presence of an alcohol at low temperature to separate sterols and any glycerides present therein (such as monoglycerides, diglycerides or triglycerides) in the form of crystal. The alcohol used in this step is preferably a lower alkyl alcohol, such as methanol, ethanol, propanol, butanol or a combination thereof. The composition comprising tocotrienols/tocopherols in 5 to 35 wt % forms a mixture upon addition of an alcohol and the mixture formed thereof is chilled to a temperature of −30 to 0° C. for a period of 12 hours to 3 days. During the crystallisation step, the mixture is optionally, but preferably, subjected to continuous agitation.

Resulting from the crystallisation, the sterol crystals and the glyceride crystals are formed. By repeatedly performing the crystallisation step, it facilitates to ensure optimum recovery of sterols and glycerides. The crystals are subsequently filtered from the solution. It should be appreciated that any solid-liquid separation means can be utilised in this step. The crystals are then further processed to evaporate the solvent contained therein through heating or by other drying means.

The remaining liquid solution is heated to remove the alcohol present therein, thereby a concentrated composition comprising tocotrienols/tocopherols in an amount of 30 to 90% by weight. The concentrated composition may also contain other compounds such as squalene, sterols, carotenoids and CoQ10.

One can possibly appreciate that the steps depicted in the preceding description can be performed for more than one time, or repeatedly, under the same operating conditions specified herein, to produce an output with desirable composition or content. The steps referred herein may include transesterification, esterification, evaporation, washing, settling, separation, crystallization or a combination of two or more steps; however, it should not be limited thereto or thereby.

A further embodiment of the present invention is a process for recovering tocotrienols/tocopherols, carotenoids and sterols from crude vegetable oil, characterised in that prior to the recovery steps, the amount of the free fatty acids in the oil is reduced to 3.50% by weight, by neutralization. Preferably, the neutralization is performed such that a basic solution, such as caustic solution, is added to the crude oil to convert the fatty acids to salts which can be separated easily by filtration. It should be appreciated that preparation of the caustic solution is common in the art, whereby dissolution of caustic soda (sodium hydroxide flakes) in water forms the desired caustic solution.

In accordance with the further embodiment of the invention, the ratio of the crude oil and the caustic solution added to the crude oil should be in a range of 1:0.030-0.035. Upon adding the caustic solution to the crude oil, neutralization takes place at a temperature of 40 to 80° C. under atmospheric pressure, with or without agitation, but preferably under continuous agitation, for a duration of 20 to 90 min. The subsequent resulting mixture is then subjected to separation by centrifugation or gravitational settling, followed by decanting, in order to recover the oil phase (also referred interchangeably to as "neutralized oil" hereinafter) from the aqueous phase which contains unreacted caustic solution, water formed during neutralization and the salts of fatty acids. It should be noted that after neutralization, the free fatty acid content in the oil phase has decreased to less than 3.50% by weight, as mentioned in the preceding description.

The process according to the further embodiment of the invention comprises the steps of transesterifying the neutralized oil in the presence of an alcohol and a basic catalyst to convert the glycerides therein to fatty acid esters and glycerine, forming an ester-rich fraction and a glycerol-rich fraction; separating the ester-rich fraction from the glycerol-rich fraction; distilling the ester-rich fraction to produce a concentrated stream comprising tocotrienols/tocopherols, carotenoids and sterols; further transesterifying the concentrated stream in the presence of an alcohol and a basic catalyst to form an ester-enriched fraction and a glycerol-rich fraction; and repeating the transesterification, separation and distillation sequentially and repeatedly to obtain a composition with pre-determined concentration of tocotrienols/tocopherols, carotenoids and sterols.

Prior to transesterification, it is preferably to subject the neutralized oil to a heating step, because the neutralized oil as obtained in the preceding step may still contain undesirable aqueous substances, such as moisture. In a preferred embodiment, the heating step is performed by subjecting the neutralized oil to a temperature of 40 to 80° C. under vacuum condition or at a pressure equivalent to 100 kPa (or 76 cm Hg) under agitation, for duration of 0.5 to 12 hours, in order to separate the aqueous compounds from the neutralized oil, as well as to reduce the moisture content in the neutralized oil to a level of less than 0.20% by weight.

Subsequently, the neutralized oil with reduced moisture content is transesterified in the presence of an alcohol and a basic catalyst to convert the glycerides in the oil to fatty acid esters and glycerine, thus forming a transesterified mixture comprising glycerine, fatty acid esters, carotenoids and other impurities, such as sterols and glycerides. The alcohol used in transesterification of the neutralized oil is preferably a lower alkyl alcohol such as methanol, ethanol, iso-propanol and butanol, whilst the basic catalyst is sodium methoxide, sodium hydroxide with methanol, potassium methoxide or potassium hydroxide with methanol. Also referring to the preferred embodiment of the invention, the transesterification is conducted at a temperature of 40 to 80° C. for 20 to 90 min under atmospheric pressure, with or without agitation, but preferably with continuous agitation at 30 to 80 rpm. The ratio of the neutralized oil to the transesterification solution (i.e. the mixture of basic catalyst and alcohol) may range from 0.5-10:1.

In accordance with the preferred embodiment of the invention, it is desirable to separate the glycerides from the transesterified mixture. It can be achieved by subjecting to centrifugation or gravitational settling to produce an ester-rich fraction and a glycerine-rich fraction.

The glycerine-rich fraction is neutralized using an acid such as hydrochloric acid, acetic acid or sulphuric acid, at a temperature of 35 to 90° C., to convert the excessive basic catalyst present therein to salt which can be easily separated from the glycerine, thereby producing 75 to 90% by weight of glycerine. Preferably, the neutralization is performed for a period of 0.5 to 24 hours, so as to ensure complete conversion. Subsequently, the resultant mixture is subjected to a settling step for a period of 0.5 to 12 hours, for separating other possible residual oil matters from glycerine. Upon removal of these residual oil matters, the remaining product mixture is heated, while being agitated continuously, to a temperature of 70 to 100° C. under vacuum (or at a pressure equivalent to 100 kPa or 76 cm Hg), in order to remove the moisture or solution present therein by evaporation.

At the same time, the ester-rich portion as obtained is subjected to either direct-current or counter-current washing with a washing agent such as water, so as to substantially remove the excessive catalyst and possibly, unreacted alcohol and other impurities such as soaps which may be formed during the process and aqueous soluble unwanted compounds. Hot or cold water can be used in this step but preferably, water heated to a temperature ranging from 40 to 80° C. is used. As preferred by the present invention, the washing step is performed repeatedly until the pH of the ester-rich portion falls to a range of 6 to 8.

After washing, the moisture content in the ester-rich portion may be increased to approximately 2% by weight. Therefore, it is preferred to reduce the moisture content therein to less than 0.30% by weight prior to being subjected to the next processing step. It can be achieved by heating or vacuum drying the washed ester-rich portion to a temperature of 40 to 70° C. for 0.5 to 6 hours, under vacuum or a pressure of 100 kPa (equivalent to 76 cm Hg), preferably with recirculation, for substantially removing the moisture present therein.

After reducing the moisture content of the ester-rich fraction to less than 0.30 wt %, the resulting ester-rich fraction is distilled for producing a concentrated stream comprising tocotrienols/tocopherols, carotenoids and sterols. It should be appreciably noted that the distillation in this step is similar to that in the preceding description. Specifically, the distillation is vacuum distillation which can be performed in a single stage or multiple stages, depending on the user's preference or the desired composition of the tocotrienols/tocopherols, carotenoids and/or sterols in the concentrated stream. Preferably, the vacuum distillation is performed in a distillation column operating at a temperature of 120 to 180° C. and at a pressure of 0.001 to 0.01 kPa (0.001 to 0.1 mbar).

In a more preferable embodiment, two-step distillation is performed, where from the first distillation column operating at a temperature of 120 to 180° C. and at a pressure of 0.001 to 0.01 kPa, fatty acid esters are primarily recovered as distillate, whilst all other components remained unrecovered are discharged as residue which is to be fed into the next column which operates at a temperature of 120 to 180° C. and at a pressure of 0.001 to 0.01 kPa. Substantial portion of fatty acid esters is again removed as distillate, thereby producing a residue stream concentrated in tocotrienols/tocopherols, carotenoids and sterols.

In a more preferable embodiment, prior to distillation, the ester-rich fraction is heated, or subjected to a column dryer or by vacuum distillation, to reduce the moisture content to below 0.01% by weight.

In another further embodiment, the distillate streams obtained from the distillation step, comprising predominantly fatty acid esters, can be subjected to further processing to produce streams with higher purity or sold to the global market as that obtained.

Upon obtaining the concentrated stream comprising tocotrienols/tocopherols, carotenoids and sterols, it is further transesterified in the presence of an alcohol and a basic catalyst to form an ester-enriched fraction and a glycerol-rich fraction. Preferably, the alcohol used in this step is a lower alkyl alcohol such as methanol, ethanol, iso-propanol and butanol, whilst the basic catalyst is sodium methoxide, sodium hydroxide with methanol, potassium methoxide or potassium hydroxide with methanol. Also, it is preferred to perform the transesterification at a temperature of 40 to 80° C. for 20 to 90 min under atmospheric pressure, with or without agitation, but preferably with continuous agitation at 30 to 80 rpm. The ratio of the neutralized oil to the transesterification solution (i.e. the mixture of basic catalyst and alcohol) may range from 0.5-10:1. It should be appreciated that the further transesterification facilitates to increase the carotenoid content in the concentrated stream to a level of more than 20% by weight.

Alternatively, the ester-enriched fraction may be subjected to transesterification, separation and distillation steps repeatedly and sequentially until a composition with predetermined concentration of tocotrienols/tocopherols, carotenoids and sterols is obtained.

If the ester-enriched fraction obtained from the further transesterification step (and upon separation from the glycerol-rich fraction) comprises the predetermined concentration of tocotrienols/tocopherols, carotenoids and sterols, it is preferred to subject the ester-enriched fraction to a washing step, where it is contacted with a methanolic acidic solution, preferably containing 1 to 2% by weight of hydrochloric acid, to remove undesirable impurities present therein. One should appreciate the fact that such washing step is performed at a slightly heated condition, particularly at a temperature of 28 to 50° C. under atmospheric pressure, and that the ratio of methanolic acidic solution to the ester-enriched fraction is in a range of 4-7:1. Subsequently, the washed ester-enriched fraction is dried, thereby forming a composition comprising an increased concentration of carotenoids, particularly an amount of 20 to 50% by weight.

Upon drying, it is preferred to subject the desired composition to crystallisation in the presence of an alcohol at low temperature to separate sterols and glycerides, if present therein, (such as monoglycerides, diglycerides or triglycerides) in the form of crystal. The alcohol used in this step is preferably a lower alkyl alcohol, such as methanol, ethanol, propanol, butanol or a combination thereof. The mixture formed thereof is then chilled to a temperature of −30 to 0° C. for a period of 12 hours to 3 days. During the crystallisation step, the mixture is optionally, but preferably, subjected to continuous agitation.

Resulting from the crystallisation, the sterol crystals and glyceride crystals, if present, are formed. By repeatedly performing the crystallisation step, it facilitates to ensure optimum recovery of sterols and glycerides. The crystals are subsequently filtered from the solution. It should be appreciated that any solid-liquid separation means can be utilised in this step. The crystals are then further processed to evaporate the alcohol contained therein through heating or by other drying means.

The remaining liquid solution is heated to remove the alcohol present therein, thereby a concentrated composition comprising predominantly tocotrienols/tocopherols and carotenoids. The concentrated composition may also contain trace amounts of other compounds such as squalene, sterols, carotenoids and CoQ10. The concentrated composition may optionally be subjected to a further processing step in order to recover carotenoids using hexane, thus producing a composition comprising primarily tocotrienols/tocopherols.

One can possibly appreciate that the steps depicted in the preceding description can be performed for more than one time, or repeatedly, under the same operating conditions specified herein, to produce an output with desirable composition or content. The steps referred herein may include transesterification, esterification, evaporation, washing, settling, separation, crystallization or a combination of two or more steps; however, it should not be limited thereto or thereby.

In another further embodiment of the invention, the distillate streams obtained from the preceding distillation steps can be subjected to further process comprising the steps of esterifying the distillate streams with an alcohol in the presence of an acid catalyst to convert the fatty acids contained therein to produce an esterified mixture comprising fatty acid esters, thereby reducing fatty acid content in the oil to less than 3.50% by weight; distilling the esterified mixture for separating and removing the fatty acid esters therefrom; transesterifying the distilled mixture with an alcohol in the presence of a basic catalyst for converting glycerides present therein to fatty acid esters and glycerine, forming a transesterified mixture comprising glycerine and fatty acid esters; purifying the transesterified mixture to substantially remove glycerine therefrom; and distilling the purified mixture to substantially remove fatty acid esters, producing a composition comprising a predetermined concentration of tocotrienols/tocopherols.

The disclosure includes as contained in the appended claims, as well as that of the foregoing description. Although this invention has been described in its preferred form with a degree of particularity, it is understood that the disclosure of the preferred form has been made only by way of example and that numerous changes in the details of construction and the combination and arrangements of parts may be resorted to without departing from the scope of the invention.

The invention claimed is:

1. A process for recovering tocotrienols, tocopherols, carotenoids and sterols from crude vegetable oil, comprising the steps of:

reducing an amount of free fatty acids in the crude vegetable oil to less than 3.50% by weight of a total crude vegetable oil composition;

distilling the crude vegetable oil or fractions thereof using two distillation columns, in a sequential arrangement, each column operating under a pressure and at a temperature suitable for separating tocotrienols, tocopherols, carotenoids or sterols from the fractions;

wherein the distilling step is performed to produce a first fraction enriched with carotenoids and a second fraction enriched with tocotrienols or tocopherols;

transesterifying the first fraction in the presence of an alcohol and a basic catalyst to convert any glycerides therein to fatty acid esters and glycerine, forming a transesterified mixture comprising glycerine, fatty acid esters and carotenoids, followed by distilling the transesterified mixture to separate carotenoids; and esterifying the second fraction in the presence of an alcohol and an acid catalyst to convert fatty acids therein to fatty acid esters, forming an esterified mixture comprising fatty acid esters and tocotrienols or tocopherols, followed by distilling the esterified mixture to separate the tocotrienols or tocopherols.

2. The process according to claim 1, wherein the amount of the free fatty acids in the crude vegetable oil is reduced by distillation or neutralization.

3. A process for recovering tocotrienols, tocopherols, carotenoids and sterols from crude vegetable oil, wherein prior to a recovery step, comprising the steps of:

distilling an amount of free fatty acids in the crude vegetable oil so that the fatty free acids are reduced to 3.50% by weight;

wherein the distilling step is performed using two distillation columns, a first column operating at a temperature of 90 to 200° C. and a pressure ranging from 10 to 100 kPa and a second column operating at a temperature of at 120 to 250° C. and a pressure ranging from 0.10 to 10 kPa;

wherein the distilling step is performed to produce a first fraction enriched with carotenoids and a second fraction enriched with tocotrienols or tocopherols;

transesterifying the first fraction in the presence of an alcohol and a basic catalyst to convert any glycerides therein to fatty acid esters and glycerine, forming a transesterified mixture comprising glycerine, fatty acid esters and carotenoids, followed by distilling the transesterified mixture to separate carotenoids; and esterifying the second fraction in the presence of an alcohol and an acid catalyst to convert fatty acids therein to fatty acid esters, forming an esterified mixture comprising fatty acid esters and tocotrienols or tocopherols, followed by distilling the esterified mixture to separate the tocotrienols or tocopherols.

4. The process according to claim 3, wherein the transesterifying step is conducted at a temperature of 35 to 80° C. under atmospheric pressure, with or without agitation, for 0.50 to 12 hours.

5. The process according to claim 3, wherein the distilling step, after the transesterifying step, is performed using two distillation columns, in a sequential arrangement, each column operating under vacuum condition and at a temperature of 120 to 180° C., with the first column having an operating temperature lower than the second column.

6. The process according to claim 3, wherein the esterifying step is conducted at a temperature of 5 to 90° C. for 0.5 to 6 hours, with or without agitation.

7. The process according to claim 3, wherein the distilling step, after the esterifying step, is performed using two distillation columns, in a sequential arrangement, each column operating under vacuum condition and at a temperature of 120 to 180° C., with a first column having an operating temperature higher than a second column.

8. The process according to claim 3, further comprising the steps of separating the glycerine from the transesterified mixture to produce an ester-rich portion, prior to distilling the transesterified mixture.

9. The process according to claim 8, wherein the glycerine is separated from the transesterified mixture by centrifugation or gravitational settling, producing a glycerine-rich portion and the ester-rich portion, wherein the glycerine-rich portion is extracted and neutralized using an acid to recover glycerine therefrom.

10. The process according to claim 8, further comprising the steps of:

washing the transesterified mixture with a washing agent to remove catalyst, unreacted alcohols and other impurities; and heating the washed and transesterified portion to reduce moisture content therein to less than 0.30 wt %, in which the heating step is conducted at a temperature of 35 to 80° C. under vacuum or a pressure of 100 kPa for 0.5 to 12 hours.

11. The process according to claim 3, further comprising the steps of:

adding an organic solvent into the distilled transesterified mixture;

chilling the mixture to produce crystallised carotenoids;

centrifuging the resulting mixture to produce a top layer and a bottom layer;

wherein the bottom layer comprises crystallised carotenoids in an amount of 28 to 45% by weight.

12. The process according to claim 11, further comprising the steps of:

heating the bottom layer at a temperature of 45 to 80° C. under vacuum condition of 70 to 75 cm Hg to evaporate the solvent contained therein to a level of less than 1% or lower for recovery of carotenoids.

13. The process according to claim 11, further comprising the steps of:

transesterifying the top layer in the presence of an alcohol and a basic catalyst to increase the carotenoid content therein; and washing the mixture obtained thereof with a methanolic acid solution to remove impurities present therein.

14. The process according to claim 3, further comprising the steps of:

transesterifying the distilled esterified mixture in the presence of an alcohol and a basic catalyst to convert the fatty acids therein to fatty acid esters, forming a product mixture comprising glycerine and fatty acid esters.

15. The process according to claim 14, wherein the transesterifying step is conducted at a temperature of 5 to 90° C. with or without agitation for 0.5 to 6 hours.

16. The process according to claim 14, further comprising the steps of:

distilling the product mixture with reduced moisture content to obtain a composition with a pre-determined concentration of tocotrienols, tocopherols and sterols.

17. The process according to claim 16, wherein the distilling step is performed using two distillation columns, in a sequential arrangement, one column operating at a temperature of 120 to 180° C. and a pressure of 0.01 to 10 kPa and a second column operating at a temperature of 120 to 180° C. and a pressure of 0.01 to 3 kPa.

18. The process according to claim 16, further comprising the steps of:

separating the sterols from the composition.

19. The process according to claim 18, wherein the sterols are separated by treating the composition with an alcohol and chilling the resulting mixture to produce crystallised sterols that are to be filtered.

20. A process for recovering tocotrienols, tocopherols, carotenoids and sterols from crude vegetable oil, comprising the steps of:

reducing an amount of free fatty acids in the crude vegetable oil to less than 3.50% by weight of a total crude vegetable oil composition by neutralizing the crude vegetable oil with a basic solution so as to convert fatty acids to salts that are separated out by filtration;

transesterifying the neutralized vegetable oil in the presence of an alcohol and a basic catalyst to convert glycerides therein to fatty acid esters and glycerine, forming an ester-rich fraction and a glycerol-rich fraction;

separating the ester-rich fraction from the glycerol-rich fraction;

distilling the ester-rich fraction to produce a concentrated stream comprising tocotrienols, tocopherols, carotenoids and sterols, in which the distilling step is performed using distillation columns arranged sequentially, each column operating at a pressure of 0.001 kPa to 0.01 kPa and at a temperature of 120 to 180° C.;

further transesterifying the concentrated stream in the presence of an alcohol and a basic catalyst to form an ester-enriched fraction and a glycerol-rich fraction; and repeating the transesterification, separation and distilling steps sequentially and repeatedly to obtain a composition with a pre-determined concentration of tocotrienols, tocopherols, carotenoids and sterols.

21. The process according to claim 20, wherein the neutralization is performed such that a basic solution is added to the crude vegetable oil to convert the fatty acids to salts that are to be separated by filtration.

22. The process according to claim 20, further comprising the steps of:

heating the neutralized vegetable oil at a temperature of 40 to 80° C. under vacuum condition or at a pressure equivalent to 100 kPa under agitation for a duration of 0.5 to 12 hours, prior to transesterification, to reduce the moisture content in the neutralized vegetable oil to a level of less than 0.20% by weight.

23. The process according to claim 20, further comprising the steps of:

washing the ester-rich portion with a washing agent to remove catalyst, unreacted alcohols and any impurities, prior to the distilling step.

24. The process according to claim 23, further comprising the steps of:

heating the washed ester-rich portion to reduce moisture content therein to less than 0.30 wt %, in which heating is conducted at a temperature of 40 to 70° C. under vacuum or a pressure of 100 kPa.

25. The process according to claim 20, further comprising the steps of:

washing the ester-rich portion with a washing agent to remove catalyst, unreacted alcohols and any impurities.

26. The process according to claim 20, further comprising the steps of:

washing the composition with predetermined concentration of tocotrienols, tocopherols, carotenoids and sterols with a methanolic acid solution to remove any impurities present therein, wherein the washing step is performed at a temperature of 28 to 50° C. under atmospheric pressure.

27. The process according to claim 26, further comprising the steps of:

crystallizing the dried composition in the presence of an alcohol to separate the sterols and glycerides, if present therein, in a form of crystals, in which the crystallization is performed at a temperature of −30 to 0° C. for a period of 12 hours to 3 days.

28. The process according to claim 26, further comprising the steps of:

separating the sterol crystals and glyceride crystals, if present; and evaporating the alcohol contained therein by heating.

29. The process according to claim 20, wherein the basic solution is a caustic solution.

30. The process according to claim 20, wherein the basic catalyst is sodium methoxide, sodium hydroxide in methanol, potassium methoxide or potassium hydroxide in methanol.

31. The process according to claim 20, wherein the alcohol is any one of methanol, ethanol, propanol or butanol.

32. The process according to claim 11, wherein the organic solvent is any one of hexane, heptane, iso-octane, acetone or ethyl acetate.

33. The process according to claim 3, wherein the acid catalyst is any one of hydrochloric acid, acetic acid, sulphuric acid or citric acid.

34. The process according to claim 1, wherein the crude vegetable oil is any one of crude palm oil, red palm oil, red palm olein, red palm fiber oil or any crude oil having a free fatty acid content of more than 3.50% by weight of the total crude vegetable oil composition.

* * * * *